US010041261B2

(12) United States Patent
Shank

(10) Patent No.: US 10,041,261 B2
(45) Date of Patent: Aug. 7, 2018

(54) DECK GAP CLEANING TOOL

(71) Applicant: Gregory Stephen Shank, Bellevue, WA (US)

(72) Inventor: Gregory Stephen Shank, Bellevue, WA (US)

( * ) Notice: Subject to any disclaimer, the term of this patent is extended or adjusted under 35 U.S.C. 154(b) by 284 days.

(21) Appl. No.: 15/186,500

(22) Filed: Jun. 19, 2016

(65) Prior Publication Data

US 2016/0374530 A1 Dec. 29, 2016

Related U.S. Application Data

(60) Provisional application No. 62/184,250, filed on Jun. 25, 2015.

(51) Int. Cl.

| | |
|---|---|
| ***B08B 7/00*** | (2006.01) |
| ***A47L 13/00*** | (2006.01) |
| ***E04F 21/165*** | (2006.01) |
| *E04D 15/00* | (2006.01) |

(52) U.S. Cl.

CPC ..... *E04F 21/165* (2013.01); *E04D 15/006* (2013.01)

(58) Field of Classification Search

CPC ..... H01T 21/04
USPC ..... 15/104.001; 134/6
See application file for complete search history.

(56) References Cited

U.S. PATENT DOCUMENTS 1,223,064 A * 4/1917 Meader ..... H01T 21/04 15/104.011
2,236,093 A * 3/1941 Friend ..... B44D 3/162 15/236.06
4,229,032 A * 10/1980 Murphy ..... A47L 13/08 15/236.06
4,358,123 A * 11/1982 Richards ..... A47L 13/24 15/246
5,054,278 A * 10/1991 Thorndike ..... A01B 1/00 280/47.3
5,058,275 A * 10/1991 Staubli ..... B25D 17/02 15/105.5
5,350,021 A 9/1994 Walker
(Continued)

FOREIGN PATENT DOCUMENTS

CA 2449328 A1 5/2005

OTHER PUBLICATIONS

Elliott, Vicky, New Deck-Cleaning Device Clears Out Gunk Between Boards, SFGate, Dec. 24, 1997, San Francisco, CA, article found at www.sfgate.com.

(Continued)

*Primary Examiner* — Nina Bhat

(57) ABSTRACT

One embodiment of a tool for cleaning the gaps between boards (48) that includes a handle (42) attached to a handle adapter (36) that is fastened to an elongated tube (20) at a midpoint. A plurality of independently adjustable blades (22) are slid onto the tube (20), and secured with pressure by fasteners. Height-adjustment glides (30) are fastened to the tube (20) so that the blades (22) are positioned at a depth for both the most effective cleaning of gaps (48), and also to avoid the blades (22) having excessive contact with supporting joists (46) during tool operation. The glides (30) are made so they will slide over the deck surface without causing damage to boards (44) or surface treatments. To remove accumulated debris, the blades (22) are moved back and forth in the gaps (48) by pulling and pushing the handle (42).

15 Claims, 13 Drawing Sheets

(56) References Cited

U.S. PATENT DOCUMENTS

| | | | | | |
|---|---|---|---|---|---|
| 5,471,696 | A * | 12/1995 | Linfoot | A47L 13/00 | 15/104.001 |
| 5,666,683 | A * | 9/1997 | Gairdner | A47L 13/08 | 15/104.001 |
| 5,740,577 | A * | 4/1998 | Wade | E01C 23/0913 | 15/104.001 |
| 5,850,657 | A * | 12/1998 | List | A47L 13/08 | 15/105 |
| 6,205,608 | B1 * | 3/2001 | Bowen | A47L 13/08 | 15/104.001 |
| 6,757,928 | B2 | 7/2004 | Lee | | |
| 8,069,531 | B2 | 12/2011 | Ruston | | |
| 8,438,687 | B2 * | 5/2013 | Cybulski | A47J 37/0786 | 15/111 |
| 9,277,847 | B2 * | 3/2016 | Epting | A01B 1/20 | |
| 2002/0189037 | A1 * | 12/2002 | Lee | A47L 13/02 | 15/104.001 |

OTHER PUBLICATIONS

Wormer, Andrew, Deck Groove Cleaner, Professional Deck Builder Magazine, May 13, 2015, Williston, VT, article found at www.deckmagazine.com.

* cited by examiner 42
20
34
26
26
26

42
36
38
20
30
26
32
22

40

34
50
52
40

DECK GAP CLEANING TOOL

CROSS-REFERENCE TO RELATED APPLICATIONS

This application claims the benefit of provisional patent application Ser. No. 62/184,250, filed 2015 Jun. 25 by the present inventor.

BACKGROUND

Prior Art

The following is some of the prior art that presently appears relevant:

U.S. Patents

| Patent Number | Kind Code | Issue Date | Applicant |
|---|---|---|---|
| 8,069,531 | B2 | 2011 Dec. 6 | Ruston |
| 6,757,928 | B1 | 2004 Jul. 6 | Lee |
| 6,205,608 | — | 2001 Mar. 27 | Bowen |
| 5,666,683 | — | 1997 Sep. 16 | Gairdner |
| 5,471,696 | — | 1995 Dec. 5 | Linfoot |
| 5,350,021 | — | 1994 Sep. 27 | Walker |

Foreign Patent Documents

| Foreign Doc. Nr. | Cntry Code | Kind Code | Pub. Dt | App or Patentee |
|---|---|---|---|---|
| 2449328 | CA | A1 | 2005 May 13 | Heller |

Nonpatent Literature Documents

ELLIOTT, VICKY, New Deck-Cleaning Device Clears Out Gunk Between Boards, SFGate, Dec. 24, 1997, San Francisco, Calif., article found at www.sfgate.com.

WORMER, ANDREW, Deck Groove Cleaner, Professional Deck Builder Magazine, May 13, 2015, Williston, Vt., article found at www.deckmagazine.com.

Deck boards or boards of similar structures such as patios, balconies, gazebos, walkways and porches are made primarily of wood, synthetics, composites or metal materials, and over time the gaps, grooves or spaces between these boards can accumulate various types of debris including food particles, dirt, leaves, twigs, seeds, feathers, animal fur, etc. Such accumulation can be unsightly, but more importantly can damage the boards or result in poor drainage and water build up on the deck surface. This can have the negative impact of shortening the life of the decking boards, particularly wood boards. In extreme cases the water can build up to such an extent that it can seep into the siding of an attached building. This can result in rot and encourage infestation of moist material by mold, mildew and fungi, or by insects such as carpenter ants, any and all of which can do significant damage to and weakening of the building's supporting structure. This potentially can pose significant health risks to people living or working in such buildings. Such problems gives rise to the need for a tool that can effectively and efficiently remove such debris from deck gaps to achieve proper drainage without damaging the deck boards or underlying structure supporting the boards.

Deck boards are produced, as indicated above, with a variety of materials, and such materials come in different thicknesses and widths. For example, in the United States the most common deck board sizes, expressed in inches thick and wide, are normally designated 2×6, 2×4, 5/4×6, and 5/4×4. However, the actual cross-sectional dimensions are 1.5"×5.5" (3.8 cm×14 cm), 1.5"×3.5" (3.8 cm×8.9 cm), 1"×5.5" (2.5 cm×14 cm) and 1"×3.5" (2.5 cm×8.9 cm), respectively. However, even these standard sizes can vary slightly due to various factors such as manufacturing and milling processes or moisture content in the case of wood boards. Furthermore, particularly in the case of wood boards, over the life of the deck the boards can expand and contract due to heat, cold, and moisture. Additionally, boards made from different parts of a tree, e.g. the inner heartwood versus the outer sapwood, will expand and contract differently. Also, some decks are even designed with patterns that utilize different deck board widths.

In addition to the material sizing differences, it is necessary to understand deck construction practice differences that can impact spacing of deck boards. The spacing of the gaps between boards can be different for different decks. One builder may decide given the climate of the area or the time of year the work will be done or based on estimated moisture content of wood boards that the spacing will need to be a certain width. In another case a builder may choose distinct board spacing width based on a different set of circumstances.

Furthermore, the spacing of the gaps between deck boards can vary not only between different decks, but also within the same deck. As deck boards are attached on the upper most part of the supporting structure, commonly known as joists in the art, the builder typically will attach boards in rows from one end to the other end of the completed deck frame, i.e., joists, beams and posts. As he approaches the final rows of decking boards to be attached, often the spacing of boards is adjusted by the builder by measuring out the remaining part to where both ends of the last row of board will be. If they are not equal, to make up the difference, the builder can increase the gaps between the boards slightly on the longer side and decrease them slightly on the shorter side for those last several rows of boards.

In the previous example, where the builder measured out the remaining part to where both ends of the last row of boards will be, it could be that the distances are roughly equal. However, the distance may be such that the gap spacing for all remaining boards must be either increased slightly or decreased slightly to avoid ending with only enough space for the last row of boards to be of a width that will not accommodate fasteners effectively and perhaps also look out of place compared to the width of the rest of the boards.

Taking into account the various issues decks face as outlined above there is a need for a tool that can effectively and efficiently clean gaps between boards while at the same time not damage the boards or underlying deck support structure. Such a tool should also be manufactured in a cost effective manner, have good ergonomics, and be easy to use. There have been various tools and methods that have attempted to address this need, but all with only limited degrees of success.

Much of the prior art were designed with only a single blade attached in some fashion to a long handle including U.S. Pat. No. 6,757,928 to Lee (2004), U.S. Pat. No. 6,205,608 to Bowen (2001), U.S. Pat. No. 5,666,683 to Gairdner (1997), U.S. Pat. No. 5,471,696 to Linfoot (1995), U.S. Pat. No. 5,350,021 to Walker (1994), and Canadian Pat.

No CA 2449328 to Heller (2005). All such single-blade solutions are tedious and very time inefficient, which can be a strong disincentive to regular cleaning of deck gaps. Some of these single-blade devices, such as the tool in U.S. Pat. No. 5,471,696 to Linfoot (1995), are designed so that either the blade is in the proper cleaning position with improper tool operating ergonomics, or if the tool is operated with good ergonomics, as shown in FIGS. 6 and 7 of that patent, the blade does not appear to be in the most effective cleaning position throughout the range of motion when using the tool.

U.S. Pat. No. 6,757,928 to Lee (2004) refers to a single-blade version of the invention as the "preferred embodiment", and is shown in FIG. 3 of that patent. A second embodiment is described as using multiple cleaning heads and blades, and is shown in FIG. 8 of that patent. However, both the description and the drawing of this second embodiment clearly indicate that these cleaning heads are attached at fixed points on the tool called "slots." This means that the cleaning heads are not adjustable to account for various combinations, in deck gap spacing and board widths as I discussed in detail above, and thereby significantly limiting this second embodiment to decks that have only very specific deck spacing and board widths. Additionally, both embodiments are designed so that the bottom of the cleaning head(s) "remain flush with the deck flooring surface". This is problematic for at least two reasons. Firstly, over time deck surfaces can develop various kinds of imperfections such as fasteners, deck board ends, or splinters that have raised up higher than the rest of the deck surface. As the cleaning head(s) are moved over the deck surface they would likely snag or catch on such imperfections thereby causing damage to the fasteners and boards or even to the tool. Secondly, even without such imperfections the bottom sides of the cleaning head(s) will rub or scrape on the deck surface during the entire gap cleaning process. There is a strong possibility that a measurable amount of damage to the deck surface will occur such as scratches, splinters or chips in the deck board materials or in surface treatments such as paints or stains. Another problem with the second embodiment is that the cleaning head support, cleaning heads, and blades taken altogether appear to require a substantial amount of material, which could make the tool heavy as well as expensive to manufacture.

SUMMARY

A deck gap cleaning tool that in accordance with one embodiment comprises a handle attached to a handle adapter that is fastened to an elongated tube at a midpoint, and a plurality of independently adjustable cleaning blades are slid onto the tube and positioned at various points along tube depending on deck board width and gap spacing. Blades are secured on tube with pressure by fasteners. Blades are adjustable at any time before, during or after the cleaning process, and are curved downward relative to tube. Height-adjustment glides that raise or lower the tube are fastened to the bottom of both ends of tube so that blades will be positioned at the appropriate depth for most effective cleaning of gaps based on the thickness of deck boards. Setting the proper height of glides also helps blades avoid excessive contact with supporting deck joists during tool operation. Glides are made of a hard yet smooth material and curved upward from the bottom so that they will slide over deck surface and any imperfections without damaging deck or tool. To remove accumulated debris, blades are inserted into gaps, and moved back and forth by pulling and pushing handle.

DRAWINGS—FIGURES

In the drawings, closely related figures have the same number but different alphabetic suffixes. Various objects, features and attendant advantages of one or more embodiments will become fully appreciated as the same becomes better understood when considered in conjunction with the accompanying drawings, in which like reference characters designate the same or similar parts throughout the several views, and wherein.

Figure 1:
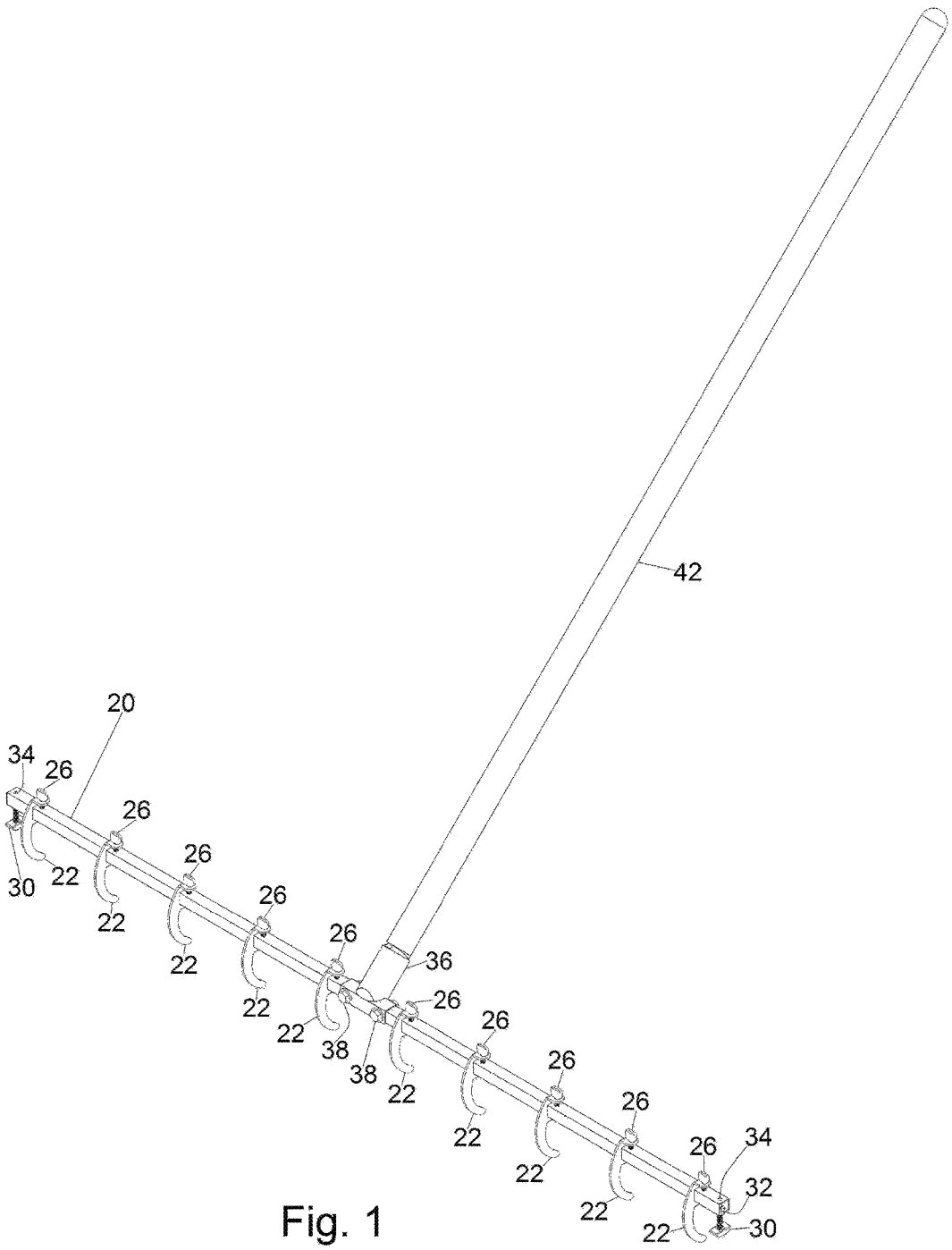
FIG. 1 is a perspective view of the tool constructed in accordance with one embodiment.

| DRAWINGS-REFERENCE NUMERALS | |
|---|---|
| 20 | elongated tube |
| 22 | blade |
| 24 | blade tube hole |

-continued

| DRAWINGS-REFERENCE NUMERALS | |
|---|---|
| 26 | blade fastener |
| 28 | threaded fastener hole |
| 30 | height-adjustment glide |
| 30A | height-adjustment wheel |
| 32 | glide fastener |
| 32A | wheel fastener |
| 34 | glide hole |
| 36 | handle adapter |
| 38 | handle adapter fastener |
| 40 | handle adapter fastener hole |
| 42 | elongated handle |
| 44 | deck board |
| 46 | joist |
| 48 | gap between board |
| 50 | elongated bar |
| 52 | elongated rod |

DETAILED DESCRIPTION—FIGS. 1, 2, 3, 4, 8A to 8G—FIRST EMBODIMENT

Figure 2:
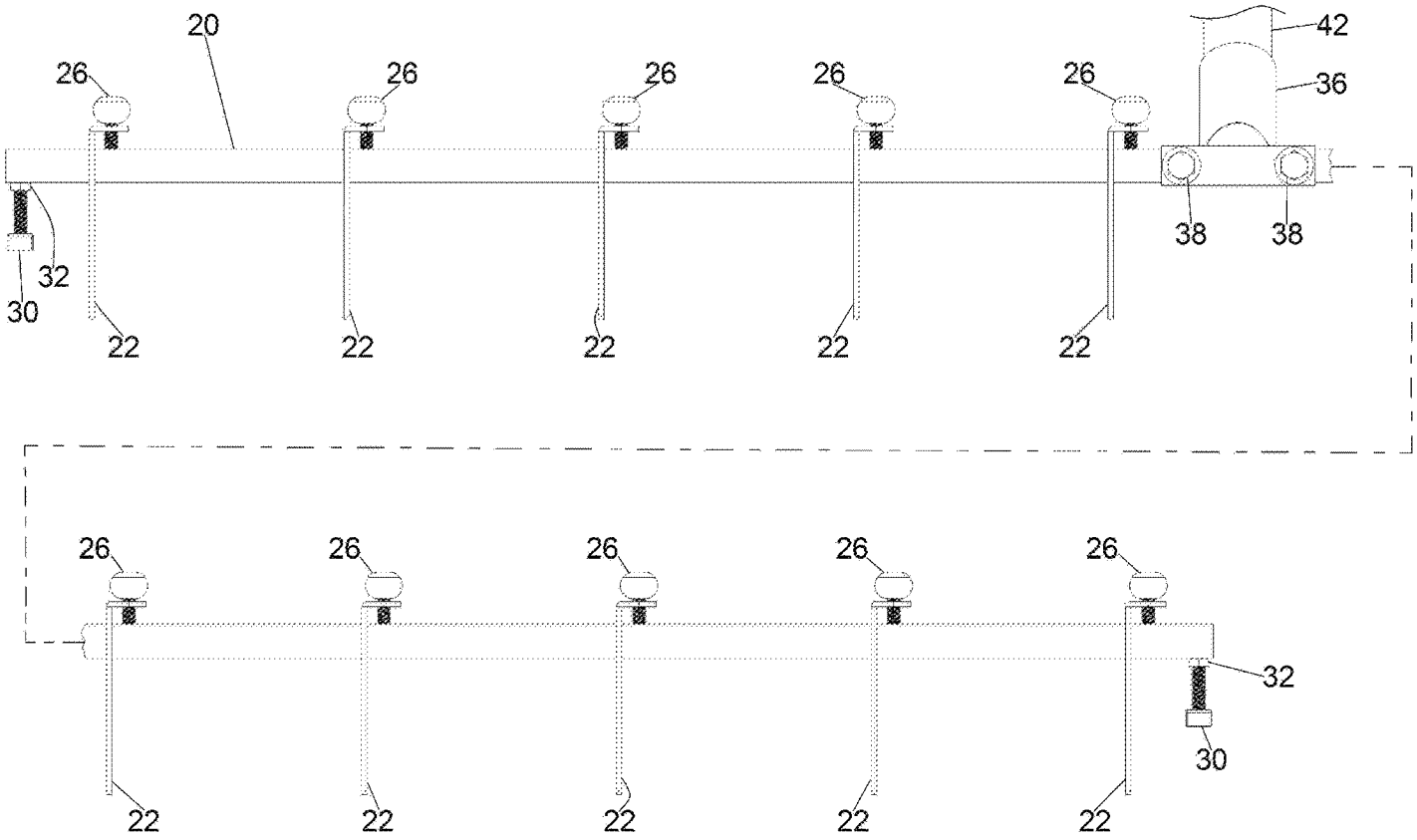
FIG. 2 is a front view of the tool of FIG. 1.
Figure 3:
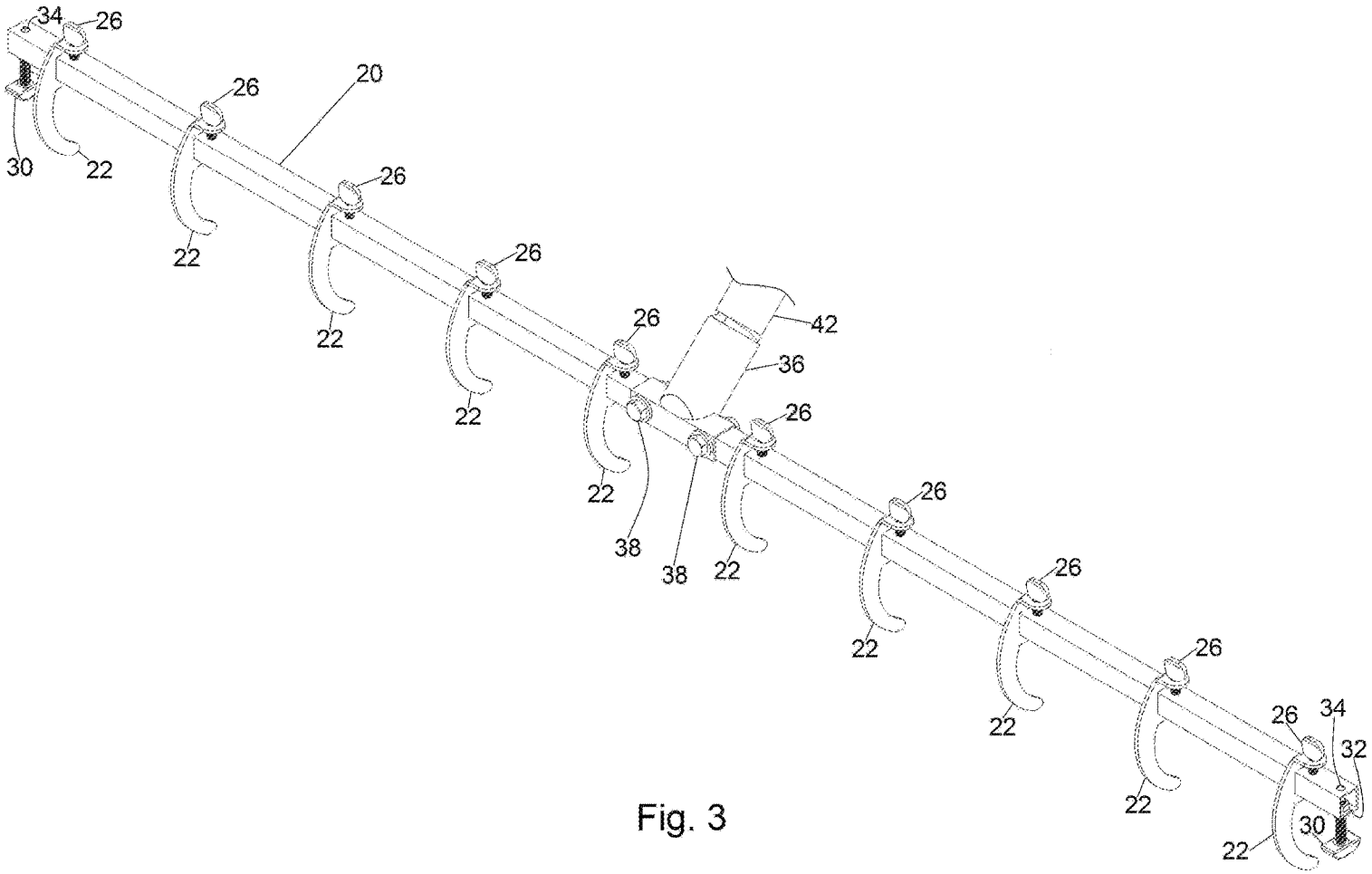
FIG. 3 is a perspective view, of the tool of FIG. 1.
Figure 4:
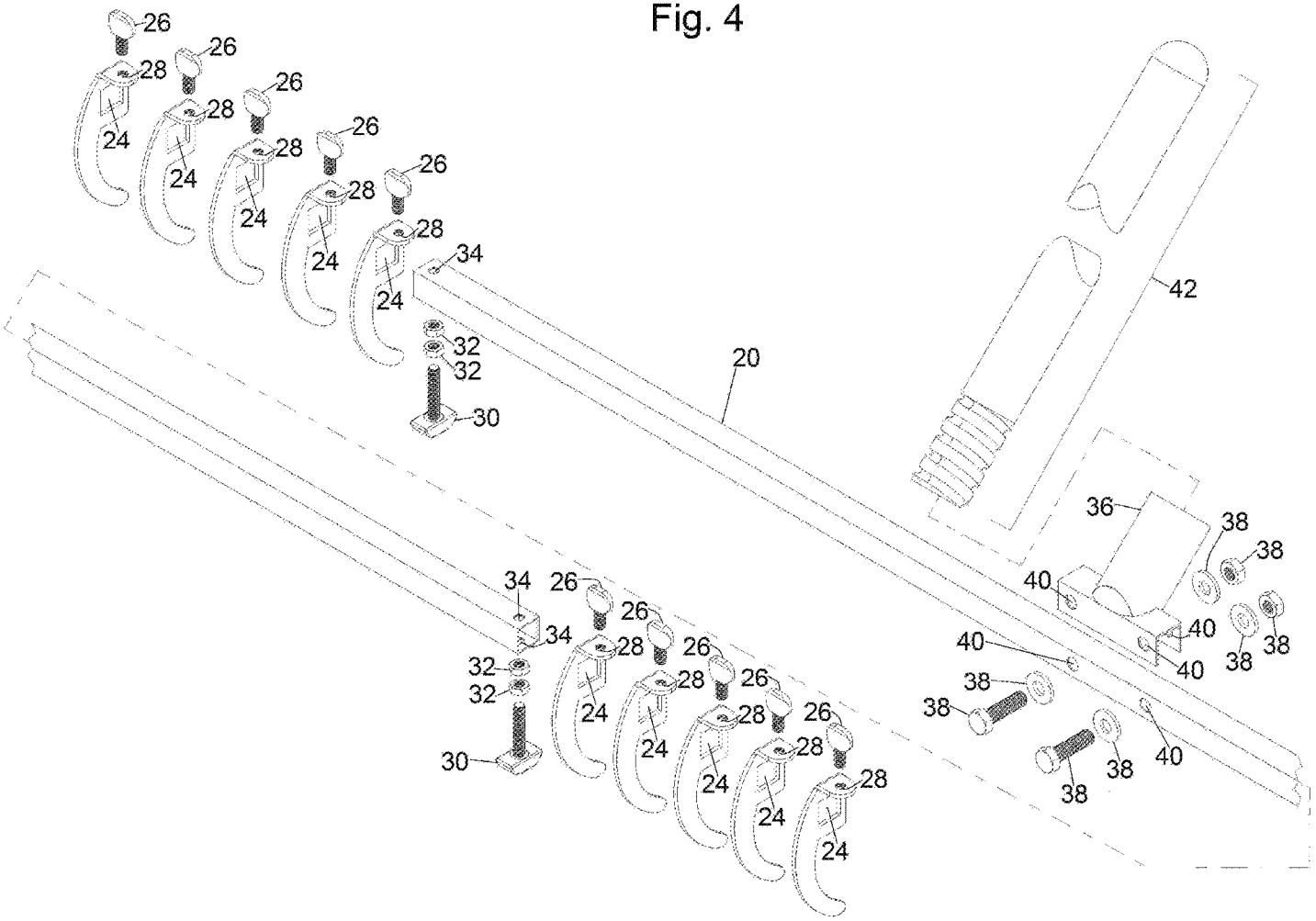
FIG. 4 is an exploded perspective view of the tool of FIG. 1.

One embodiment of the tool is illustrated in FIG. 1 (perspective view), FIG. 2 (front view), FIG. 3 (perspective view), and FIG. 4 (exploded perspective view). An elongated tube 20 receives a plurality of blades 22 each with a blade tube hole 24 that matches the shape of tube 20. Each blade 22 is slid onto tube 20. In one embodiment tube 20 and blades 22 are aluminum. However, tube 20 and blades 22 can be comprised of any hard material such as plastics, composites, stainless steel or other metals. Blade 22 is secured by a fastener 26 screwed into a threaded fastener hole 28, and tightened down onto tube 20 with enough pressure to keep blade 22 firmly in place. In one embodiment tube 20 and blade tube holes 24 are square shaped. However, in other embodiments tube 20 shapes can be round, rectangular, or various other shapes, and tube holes 24 of blades 22 are then produced to match the different tube 20 shapes. In one embodiment blade fasteners 26 are thumb screws as commonly known in the art. However, the blade fasteners 26 can be comprised of other fastener types such as bolts or wing screws.

Figure 8A:
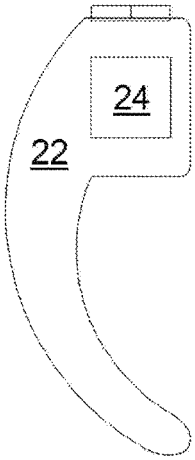
FIGS. 8A to 8G are a side view, four perspective views, a front view, and a top view, respectively, of blade in accordance with the tool of FIG. 1.
Figure 8B:
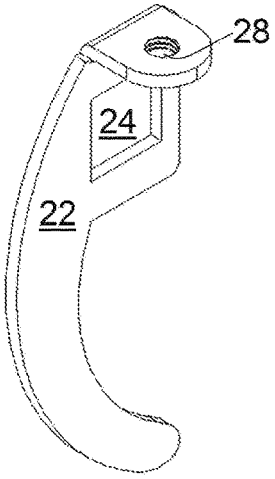
Figure 8C:
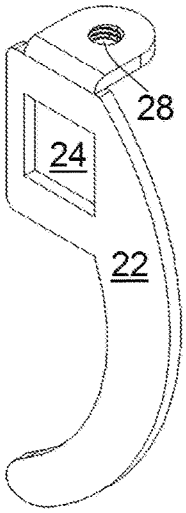
Figure 8D:
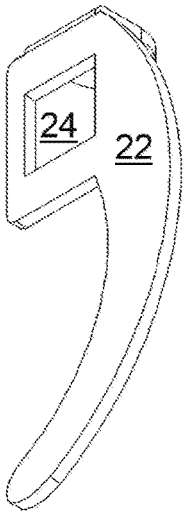
Figure 8E:
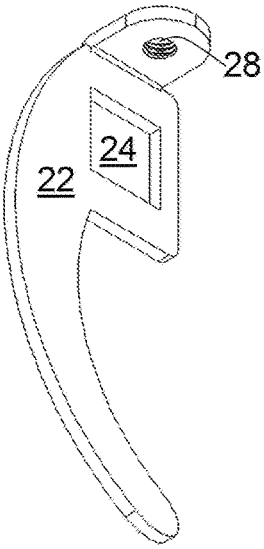
Figure 8F:
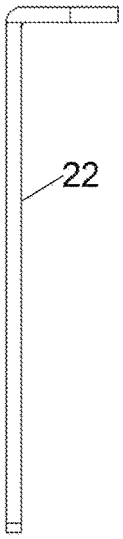
Figure 8G:
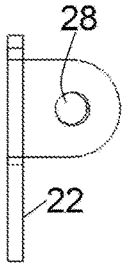
Figure 9A:
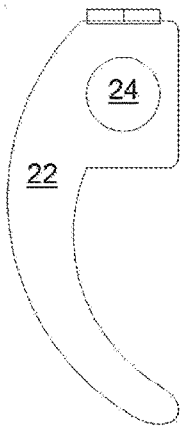
FIGS. 9A to 9C are a side view and two perspective views of a blade with round tube hole in accordance with another embodiment.
Figure 10A:
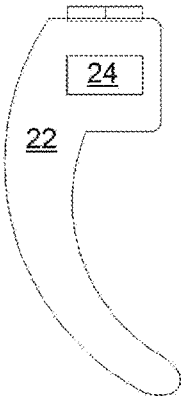
FIGS. 10A to 10C are a side view and two perspective views of a blade with a rectangular tube hole in accordance with another embodiment.

Blade 22, in one embodiment, is best shown in FIG. 4, FIG. 6, and FIGS. 8A to 8G. Blade 22 from a side view, as shown in FIGS. 8A, 9A, and 10A, is roughly shaped like a lowercase letter "e" that has an enclosed portion or "eye". Continuing with this analogy, the "eye" equivalent part of the blade 22, called blade tube hole 24, has a shape that matches the shape of tube 20 though is slightly larger so it can be received onto tube 20. The forward-facing edge of blade 22, i.e., that faces away from the operator, has a convex curvature that starts above tube 20. It first curves downward and slightly outward relative to tube 20. Its downward curve ends at rounded tip of blade 22 that is a predetermined distance below the backward-facing, i.e., facing toward the operator, vertically-oriented, upper part of blade 22. Much of gap 48 cleaning portion of convex edge of blade 22 has approximately a forty-five degree angle down and away from the operator. From the rounded tip, the back edge of blade 22, i.e., that faces toward the operator, has a concave curvature that curves upward and ends a short, predetermined distance below the bottom of the forward-facing side of tube 20. Much of gap 48 cleaning portion of concave edge of blade 22 has approximately a forty-five degree angle up and toward the operator.

A part of the flat, horizontally-oriented, top side of blade 22 is perpendicular to the rest of blade 22, is rounded, and has threaded hole 28 that receives fastener 26 that is long enough to reach and put holding pressure on tube 20. Blade 22 is long enough to accommodate deck boards 44 of different thicknesses. The edges of blade 22 are blunted or flat and the tip is rounded, which provides for effective cleaning of gaps 48, avoids damage to boards 44 and joists 46, and is safe for the user of the tool. Blades 22 are of a thickness that allow them to be received into gaps 48. In one embodiment, blades 22 are a uniform thickness. However, blades 22 can be of different thicknesses.

The ends of elongated tube 20 receive height-adjustment glides 30 through holes 34 in the bottom and, as needed, the top of tube 20 that are secured with fasteners 32. In one embodiment, glide 30 base as shown in FIGS. 12A to 12E, is comprised of hard, smooth plastic, is rectangular-shaped from a top or bottom view, and is curved upward from the bottom on the shorter side of glide 30 base. The base of glide 30 can be comprised of any hard, smooth material such as metals or composites that can slide easily and smoothly over boards 44 without chipping or scratching or otherwise damaging boards 44 or surface treatments such as paints or stains. Also, glide 30 base can have different shapes such as oval, circular or square as long as it is curved upward from the bottom and smooth so it can slide smoothly over boards 44 as discussed above. The fastener portion of glide 30 is similar to a common threaded bolt, but can be of various other configurations. Tube 20 has holes 34 on the bottom and top near ends of tube 20 so the that fastener portion of glide 30 can be received upward through tube 20 as needed to adjust the depth of blades 22 in gaps 48 depending on board 44 thickness.

Figure 5A:
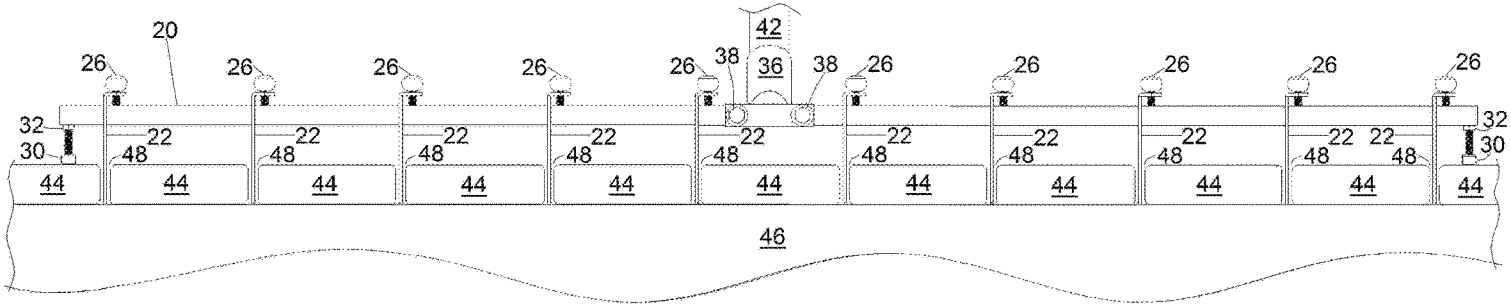
FIGS. 5A and 5B are front views of the tool inserted into gaps between deck boards of different widths and thicknesses, and with the tool adjusted to accommodate those differences.
Figure 5B:
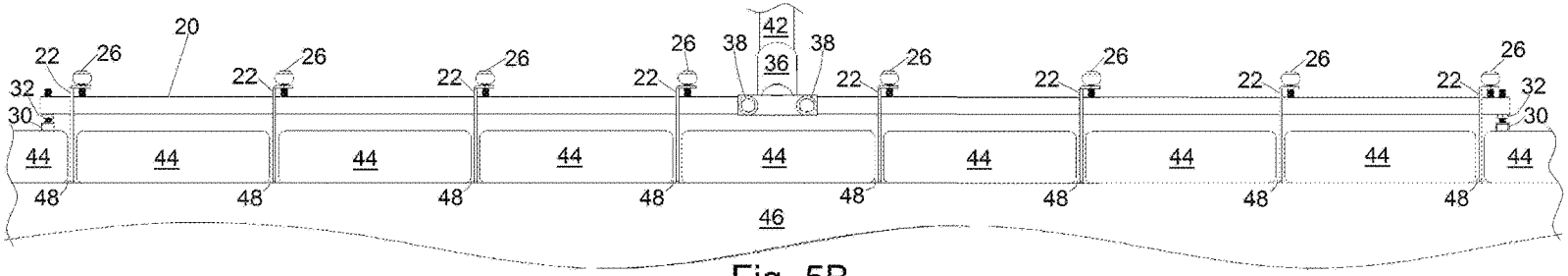
Figure 6:
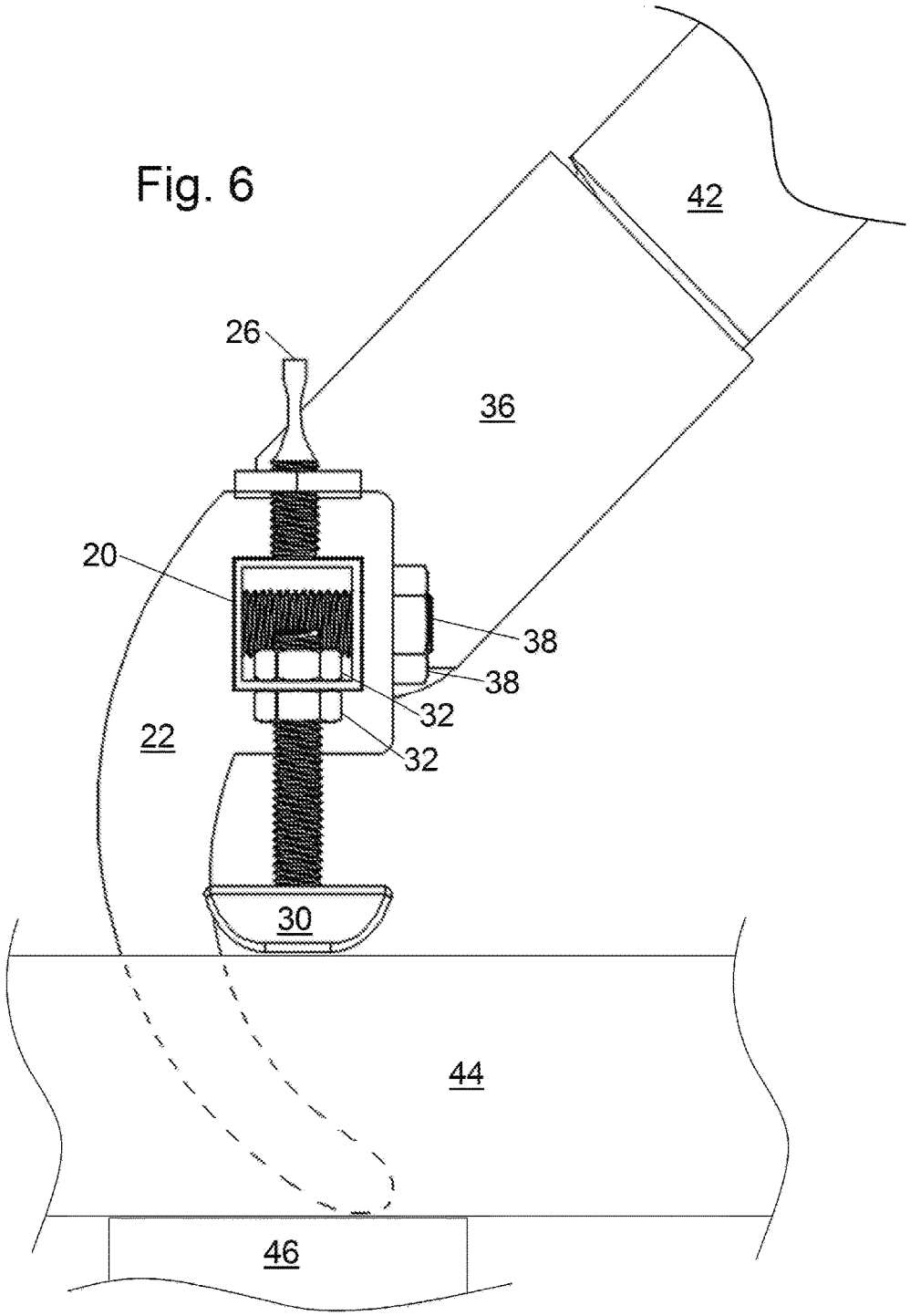
FIG. 6 is a cross-sectional side view of deck boards and supporting joist showing the tool inserted into gaps between deck boards.
Figure 7:
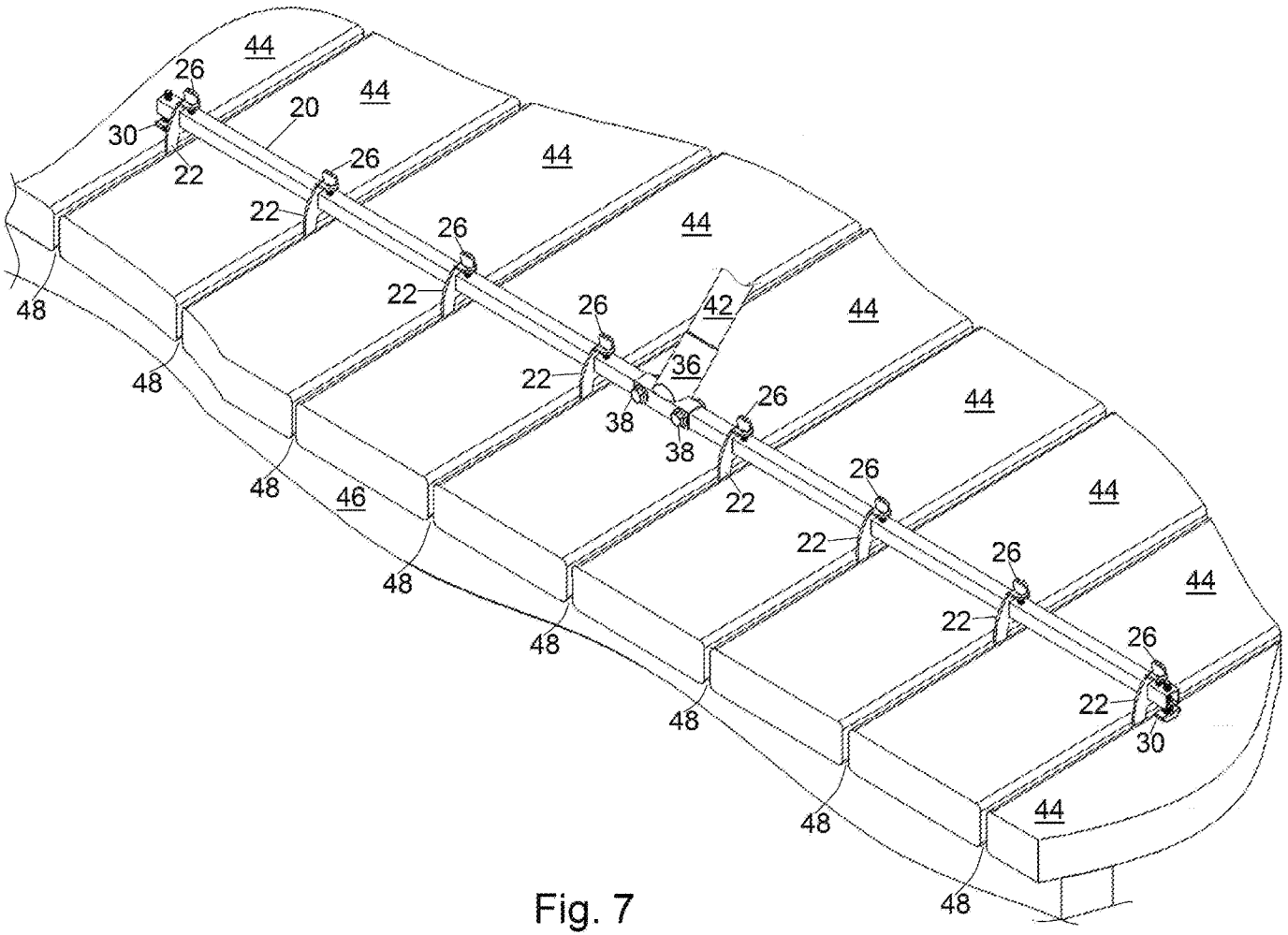
FIG. 7 is a perspective view of the tool inserted into gaps between deck boards.
Figures 14A, 14B, 14C:
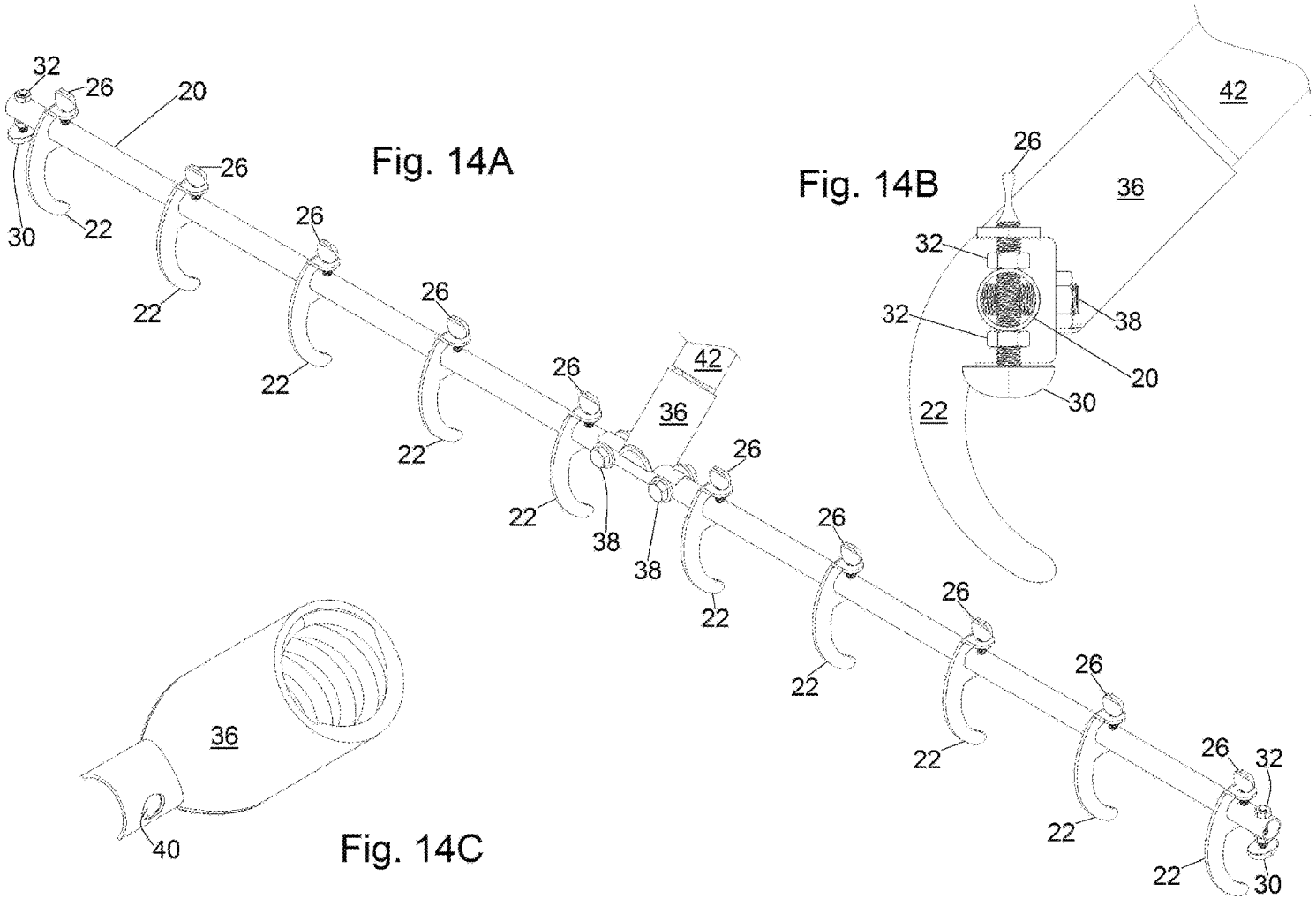
FIGS. 14A to 14C are perspective and side views of the tool with a round tube in accordance with another embodiment using height-adjustment glides shown in FIGS. 13A to 13E, and a perspective view of related handle adapter showing internal threads.

A handle adapter 36 is attached to tube 20 at a midpoint with fasteners 38 placed through holes 40 in the front and back of both the adapter 36 and tube 20 as shown in FIG. 4. In one embodiment, from front or back views as shown in FIGS. 2, 5A, 5B, and 15B, adapter 36 is shaped like an upside-down uppercase "T" with holes 40 near both ends of the horizontal portion. Horizontal portion is a 3-sided square slot large enough to fit down onto tube 20. From a side view as shown in FIGS. 6 and 14B the stem or vertical portion of adapter 36 is angled up and toward the operator at approximately forty-five degrees. Adapter 36 can be of various shapes, have different angles relative to the tool operator, and be comprised of any hard material such as plastics, composites, wood, stainless steel or other metals.

An elongated handle 42 is attached to adapter 36. In one embodiment handle 42 is the length of a common yard rake, is made of wood, and is attached to handle adapter 36 via matching threads by a screwing motion. However, handle 42 can be any desired length or of an adjustable type so that it can be set to different lengths, and can be comprised of various materials such as metals, plastics, or composites. Other means of attaching handle 42 to adapter 36 can be used such as bolting, screwing, or clamping.

Operation—FIGS. 5A, 5B, 6, 7

Tool operator places tool on the area of the deck where he wants to start cleaning deck gaps 48. He first adjusts blades 22 by sliding them along tube 20 from both ends until each lines up with consecutive gaps 48. In one embodiment as shown in FIG. 5A there are ten blades 22 positioned between eleven boards 44. Once blades 22 are positioned correctly the operator screws fasteners 26 into threaded fastener hole 28 that is the part of the top of blade 22 that is perpendicular to the rest of blade 22. He tightens down each fastener 26 onto tube 20. Once each fastener 26 is in contact with the top of tube 20, his continuing tightening brings the bottom of blade tube hole 24 into contact with the bottom of tube 20. He continues to tighten fasteners 26 until there is sufficient tension and pressure on tube 20 by both fastener 26 and the bottom of blade tube hole 24 to secure blade 22 firmly in place.

Once blades 22 are all properly positioned and fastened the operator then places blades 22 down into gaps 48 directly over a joist 46 as best shown in FIG. 6. This is so she can adjust and fasten the height-adjustment glides 30 to the appropriate depth based on the thickness of boards 44, and thereby avoid excessive and potentially damaging contact with joists 46. In FIGS. 5A and 6 the operator has set the tool to fit U.S. standard 5/4×4 deck boards 44 that are approximately 2.5 cm thick by 8.9 cm wide, and gap spacing of approximately 6.35 mm (¼ inch). In FIG. 58, which has a longer tube 20 than FIGS. 5A and 6, she set the tool to fit U.S. standard 2×6 deck boards 44 that are approximately 3.8 cm thick by 1.4 cm wide, and gap 48 spacing of approximately 6.35 mm.

Once all the adjustments to the tool are complete, and blades 22 are in gaps 48 as shown in FIGS. 5A, 5B, 6 and 7, the cleaning motion of using the tool is similar to that of other long-handled cleaning implements such as a common push broom. Namely, the operator pushes and pulls tool handle 42 back and forth to clean debris out from gaps 48, keeping glides 30 in contact with deck boards 44. Glides 30 make the tool easy and ergonomic to operate since much of the weight of the tool rests on boards 44 during operation. The concave part of the edge of blade 22 that is facing toward the operator is designed with an upward angle to more debris up and out of gaps 48 as she pulls tool towards herself. This is useful particularly for larger kinds of debris such as seeds from trees, small rocks, or other kinds of debris that might be wedged in gaps 48 and too large to be easily pushed downward and out of the bottom of gaps 48. The convex part of the edge of blade 22 that is facing away from the operator is designed with a downward angle to push debris down and out of the bottom of gap 48 as she pushes tool away from herself.

As the operator cleans a section of deck gaps 48 there will likely be debris that accumulates on the top of boards 44. He may choose to clean off such debris in a variety of ways such as with a broom, vacuum, or air blower. Once a section of gaps 48 has been cleaned to his satisfaction he moves on to another area. As he moves from section to section, if there is a difference in board 44 spacing, as I discussed above, the tool provides him the flexibility to adjust the spacing of blades 22 to match. If he has a another deck or multiple decks to clean that have different sized boards 44 and spacing, the tool provides him the flexibility to adjust both the height and spacing of blades 22 to accommodate such differences.

Figure 9B:
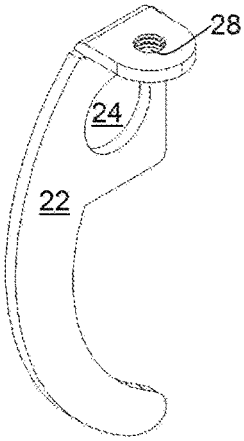
Figure 9C:
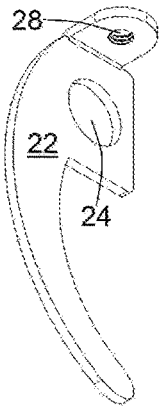
Figure 10B:
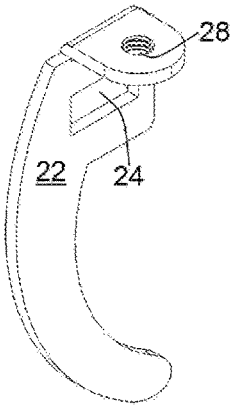
Figure 10C:
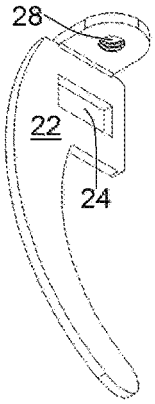
Figure 11A:
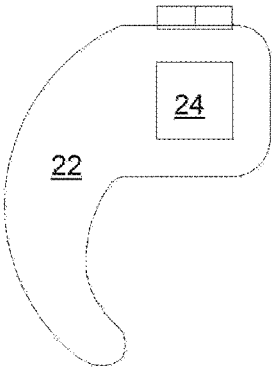
FIGS. 11A to 11C are a side view and two perspective views of blade with a square tube hole, and a different shape and thickness in accordance with another embodiment.
Figure 11B:
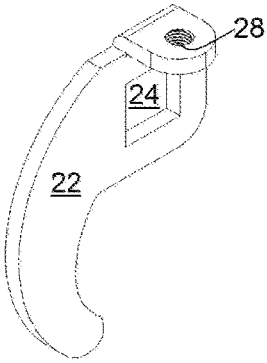
Figure 11C:
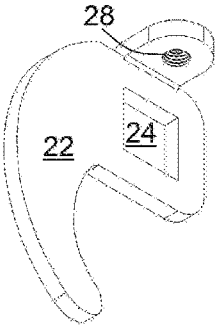
Figure 12A:
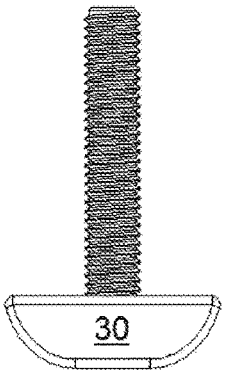
FIGS. 12A to 12E are side, front, perspective, top, and bottom views, respectively, of height-adjustment glide used in accordance with the tool of FIG. 1.
Figure 12B:
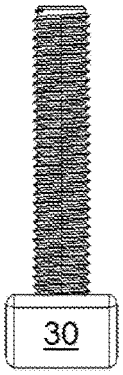
Figure 12C:
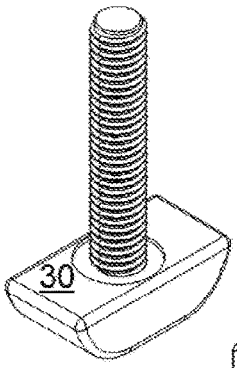
Figure 12D:
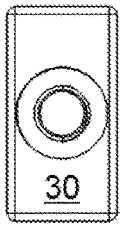
Figure 12E:
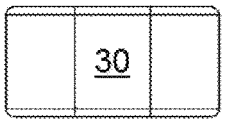
Figure 13A:
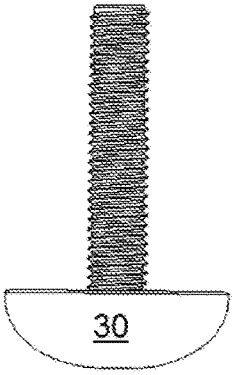
FIGS. 13A to 13E are side, front, perspective, top, and bottom views, respectively, of a height-adjustment glide in accordance with another embodiment.
Figure 13B:
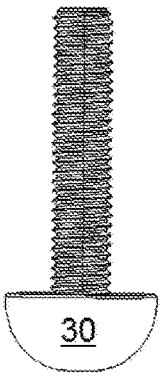
Figure 13C:
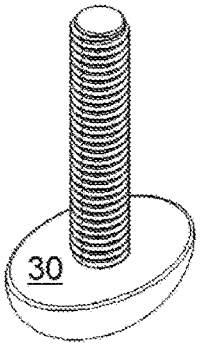
Figure 13D:
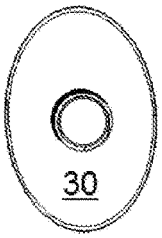
Figure 13E:
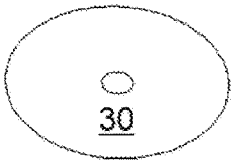

Additional Embodiments—FIGS. 9A to 9C, 10A to 10C, 11A to 11C, 13A to 13E, 14A to 14C, 15A and 15B Additional embodiments are shown in FIGS. 9A to 9C, 10A to 10C, 11A to 11C, 13A to 13E, 14A to 14C, 15A and 15B. FIGS. 9A to 9C show a blade that has a round tube hole to slide onto a round tube. FIGS. 10A to 10C show a blade that has a rectangular tube hole to slide onto a rectangular tube. FIGS. 11A to 11C show a blade of a different shape and thickness that has a square tube hole to slide onto a square tube. FIGS. 13A to 13E show a height-adjustment glide with a base that is roughly the shape of half an egg cut in half from the longer end. FIGS. 14A to 14C show the tool comprised of a round tube, blades each with a round tube hole matching round tube, a handle adapter that fits round tube, and height-adjustment glides as shown in FIGS. 13A to 13E.

Figure 15A:
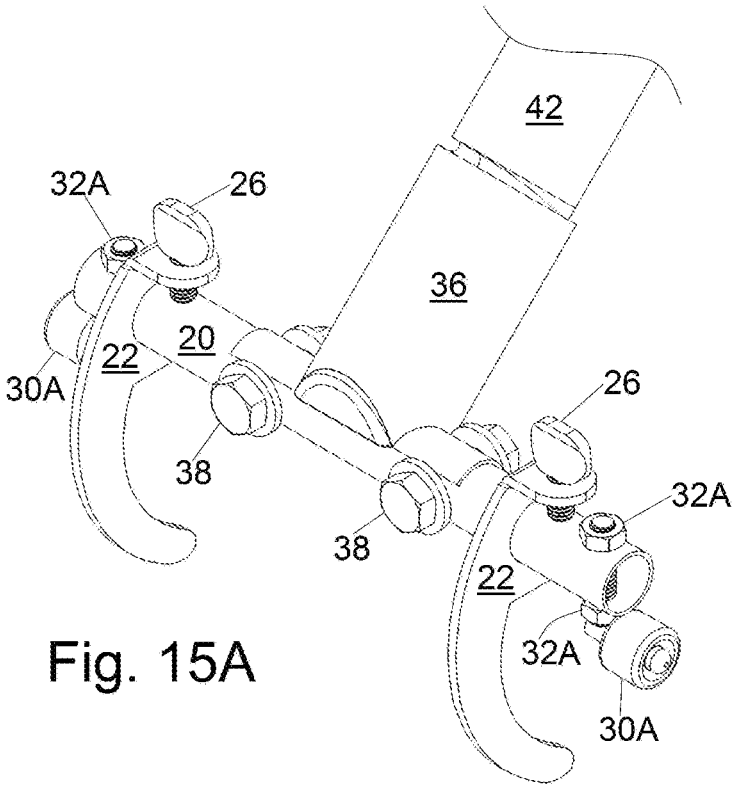
FIGS. 15A and 15B are a perspective view and a back view in accordance with another embodiment that has a shorter round tube and two blades, and that uses height-adjustment wheels.
Figure 15B:
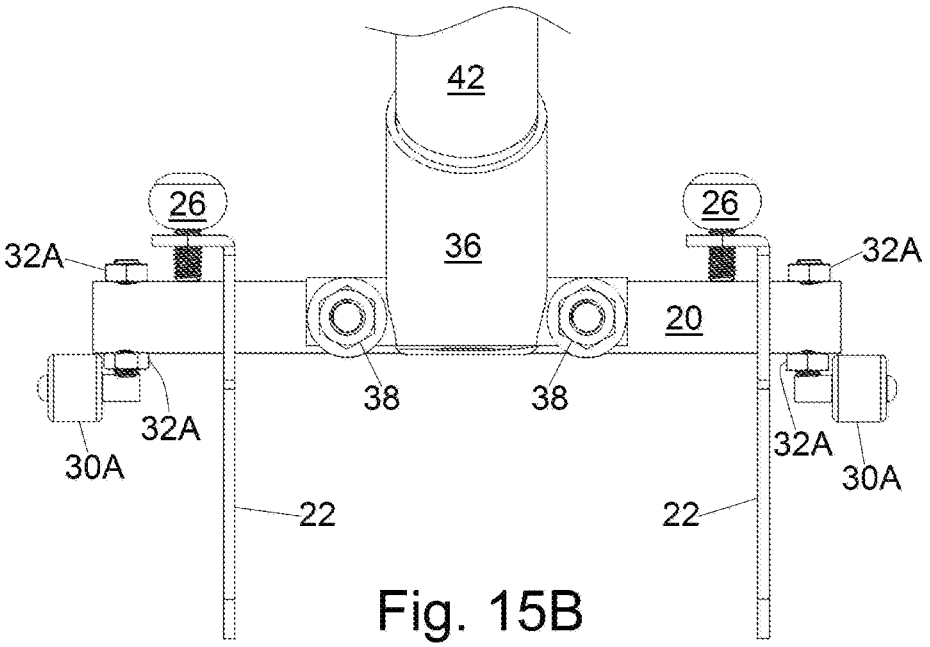
Figures 16A, 16B, 16C, 16D, 16E, 16F:
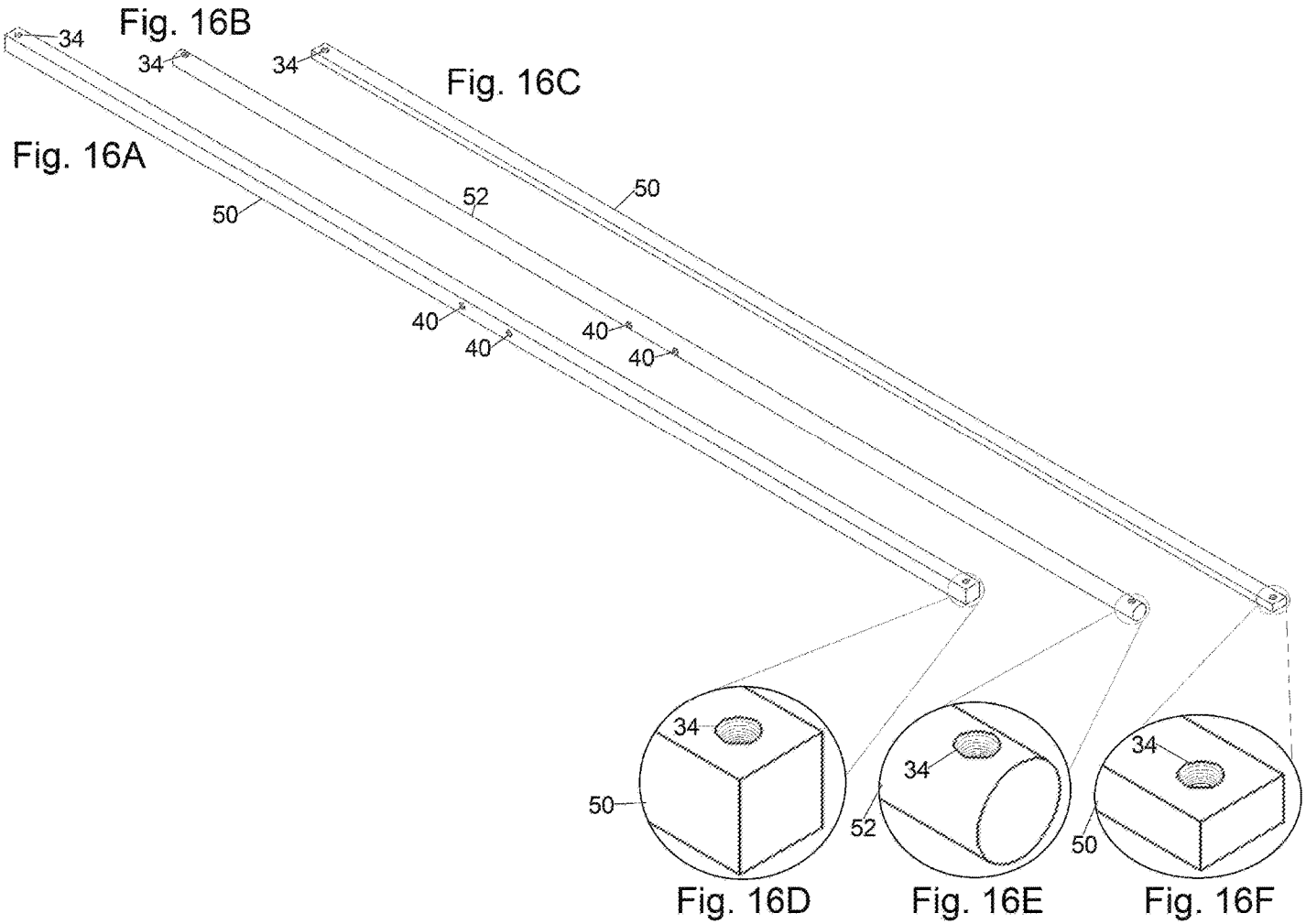
FIGS. 16A to 16F are perspective views of two different shaped solid bars and one solid rod, with enlarged views of one end of these bars and rod, in accordance with alternate embodiments.

FIGS. 15A and 15B show an embodiment with a round tube that has two blades, which is one example of an embodiment of the tool with fewer blades. Having a shorter tube with fewer blades is a useful option, for example, with decks where sections are non-right angles that narrow to the point that embodiments with more blades will not fit. To make the tool with a fewer or greater number of blades the only part that needs to change by being shortened or lengthened is the tube. In place of height-adjustment glide, a height-adjustment wheel 30A is used. Wheel has an axle that projects a predetermined distance in the direction of the tool. Axle is perpendicularly connected to threaded fastener portion that is received up through holes on bottom and top of tube and fastened 32A to tube in the same manner as glide. Height-adjustment wheel can be a variety of sizes and comprised of various materials including rubber, plastics, wood, metals, and composites. Height-adjustment wheel adjusts tool height and operates similarly to height-adjustment glide, except that rather than sliding, wheel rolls over deck surface. The parts including blades, height-adjustment wheels, handle adapter, handle, and fasteners can be used with different tube shapes and lengths.

The additional embodiments are operated in a nearly identical way as the first embodiment.

Alternative Embodiments

The previously discussed embodiments use tube of various shapes and sizes as the part to which are fastened compatible blades, height-adjustment glides, and a handle adapter. There are various possibilities with regard to the type, shape, length, thickness and materials of the tube. For example, rather than using a tube, a solid bar or solid rod is used as shown in FIGS. 16A to 16F, which are perspective views of two solid elongated bars 50 and one solid elongated rod 52 in accordance with alternate embodiments, to which can be fastened matching blades, glides or wheels, and handle adapter.

Blades, height-adjustment glides or wheels, and handle adapter are of various shapes, sizes and thicknesses, and are made of a variety of materials. For an alternate means of connecting glides or wheels and handle adapter to tube that will reduce the necessity of some fasteners such as nuts, if tube is metallic a thermal drill bit used in conjunction with a tap drill bit can be used on tube to form threaded holes. Threaded holes then receive compatibly sized fasteners such as bolts or screws to connect glides and handle adapter to tube. For the part of the top of blade that is perpendicular to the rest of blade and receives fastener such as a thumb screw, a thermal drill bit and tap drill bit can be used to increase the number of threads.

Handle adapter and handle can be made with a variety of materials such as metals, plastics, composites, and wood. Handle adapter can be of various configurations including, for example, allowing adjustment so handle is set to different angles and heights relative to the operator. Handle can be any desired length or of an adjustable type so that it can be set to different lengths. Alternate means of securing handle to handle adapter can be used such as bolting through handle and handle adapter, screwing, nailing, or clamping. Also, handle adapter and handle can be produced as a single combined part that attaches to tube.

The alternative embodiments are operated in a nearly identical way as the first and additional embodiments.

Advantages

From the description above, a number of advantages of some embodiments of my deck gap cleaning tool become evident:

(a) The tool having a plurality of adjustable blades can clean debris simultaneously from multiple deck gaps, substantially increasing efficiency, and thereby saving a significant amount of time.

(b) The adjustability of blades along tube is a positive feature of the tool given the potential variances in board widths and spacing of boards in different decks or even within a given deck.

(c) The shape of blades is excellent for cleaning gaps between boards, because debris is either pulled up and out of gaps or pushed down and through the bottom of gaps as needed depending on debris type, size, and hardness, and whether or not the debris is stuck or lodged in gaps.

(d) The tip of blade is rounded, and edges of blade are blunted or flat, which provides for effective cleaning of gaps, avoids damage to boards, surface treatments, and joists, and is safe for the user of the tool.

(e) Height-adjustment glides or wheels provide for ease of operating the tool and good ergonomics since much of its weight rests on glides or wheels during operation.

(f) The curved upward shape, and material hardness and smoothness of glide base helps avoid damage to deck surface such as scratches, splinters, or chips in the deck board materials, or to surface treatments such as paints or stains.

(g) The height-adjustment aspect of glides or wheels is another advantage of the tool, because the same length blade can accommodate various deck board thicknesses. Proper height adjustment also means that excessive, potentially damaging contact by blades with supporting deck joists is avoided.

(h) Some embodiments of the tool are made with cost-effective, standard fasteners such as thumb screws or wing screws for blades, bolts and nuts for handle adapter, and nuts for glides or wheels.

(i) The tool has the flexibility, and thus benefit from a cost effectiveness standpoint, of being manufacturable with a variety of materials including metals, plastics, composites, and wood.

(j) Another advantage of the tool is that to configure it with a fewer or greater number of blades the only part that needs to change is the tube, by using a shorter or longer version. The other parts including blades, height-adjustment glides, adapter, handle, and fasteners can be used for different tube lengths. This makes it cost effective, for example, if one acquires a version of the tool with a longer tube and more blades to then procure relatively inexpensive shorter tubes for use in configuring the tool to clean gaps in areas of deck that are narrower.

(k) Some embodiments of the tool are made with tubes, which have an excellent strength to weight ratio. This helps keeps the overall weight of the tool down, thereby improving ergonomics and ease of operating the tool.

CONCLUSION, RAMIFICATIONS, AND SCOPE

Accordingly, the reader will see that the various embodiments of my deck gap cleaning tool can be used to clean debris from deck gaps easily and effectively and efficiently, can be adjusted to accommodate different widths and thickness of deck boards and board spacing, and can be used ergonomically and safely by the operator, and without damaging the deck, surface treatments, or the tool. In addition, the tool can be manufactured in a cost effective manner, and has the flexibility of using more or fewer blades simply by procuring a tube of a different length.

Although the description above contains many specificities, these should not be construed as limiting the scope of the embodiments but as merely providing illustrations of some of several embodiments. For example, the parts of the tool can have other shapes, thicknesses, and lengths; the tool can be assembled using other fasteners and fastening methods; the parts of the tool can be fabricated using various materials, etc.

Thus the scope of the embodiments should be determined by the appended claims, and their legal equivalents, rather than by the examples given.

I claim:

1. A deck gap cleaning tool comprising: an elongated handle; an elongated member including a tube, rod or bar attached perpendicularly at an intermediate point, either directly or with a handle adapter, to one end of said handle; a plurality of blades adjustable along and fastened to said member; two glides or wheels, with vertical height adjustability, fastened perpendicularly to the bottom of said member and at predetermined points along said member; whereby said blades are each independently adjusted and fastened along said member based on width of deck boards so said blades can be received into a plurality of gaps between said boards simultaneously, and said glides or wheels are adjusted vertically and rest on top of said boards so the depth of said blades into said gaps closely matches the height of said boards, thereby keeping the tips of said blades slightly above the supporting deck structure so that operation of said tool will be unimpeded by said supporting deck structure, and said supporting deck structure will not be damaged by said blades during a normal back and forth cleaning motion of said tool by pushing and pulling said handle, thereby efficiently cleaning debris out of said plurality of said gaps simultaneously of decks or architectural structures.

2. The deck gap cleaning tool of claim 1 wherein length of said handle is adjustable.

3. The deck gap cleaning tool of claim 1 wherein said member has a predetermined shape and diameter, said member is constructed from a hard material selected from the group consisting of plastics, composites and metals.

4. The deck gap cleaning tool of claim 1 wherein said member has various predetermined lengths to accommodate different board widths.

5. The deck gap cleaning tool of claim 1 wherein said blades have vertical height of approximately 70 mm, horizontal width of approximately 30 mm, and thickness for being received into said gaps of approximately 2 mm.

6. The deck gap cleaning tool of claim 1 wherein said blade is constructed and arranged as a lowercase letter e in a plane perpendicular to said member; and has a hole of a predetermined shape and diameter for sliding said blade onto said member.

7. The deck gap cleaning tool of claim 6 wherein said blade has a forward-facing edge with a convex curvature starting at a predetermined point above said hole, and said blade has a rear facing edge with a concave curvature starting at a predetermined point below said hole, both curvatures ending at a rounded tip at the bottom of said blade.

8. The deck gap cleaning tool of claim 1 wherein the horizontally-oriented, top part of said blade has a threaded hole that receives a fastener of a predetermined length to reach and provide a downward pressure on said member.

9. The deck gap cleaning tool of claim 1 wherein said glides are curved upwardly and outwardly from the bottom and made of a hard and smooth material so that said glides will slide easily and smoothly over said boards.

10. The deck gap cleaning tool of claim 1 wherein fastener portions of said glides or wheels have predetermined lengths connected through fastener holes disposed in said member for adjusting the depth of said blades in said gaps depending on thickness of said boards.

11. The deck gap cleaning tool of claim 1 wherein the length of said blades and slidability of said blades along said member, in combination with the vertical height adjustability of said glides or wheels, removes debris from said plurality of said gaps between said boards simultaneously.

12. A method of cleaning debris from gaps between a plurality of boards simultaneously of decks or architectural structures, comprising:

(a) providing a deck gap cleaning tool comprising an elongated handle, an elongated member selected from the group consisting of a tube, rod and bar attached perpendicularly at an intermediate point, either directly or with a handle adapter, to one end of said handle, a plurality of blades slidably placed thereon, adjustable along and fastened to said member, two glides or wheels fastened perpendicularly to the bottom of said member and at predetermined points along said member which are vertically adjustable, and;

(b) using said cleaning tool and adjusting said cleaning tool blades whereby said blades are each independently adjusted and fastened along said member based on width of deck boards so said blades can be received into a plurality of said gaps between said boards simultaneously, and said glides or wheels are adjusted vertically and rest on top of said boards so the depth of said blades are adjusted to fit through said gap heights of said boards, thereby maintain the blade engagement of the tips of said blades slightly above the supporting deck structure so that said cleaning tool will be unimpeded during a normal back and forth cleaning motion by said tool, thereby efficiently cleaning debris out of gaps of decks or architectural structures.

13. The method of claim 12 wherein the length of said blades and slidability of said blades along said member, in combination with the vertical height adjustability of said glides or wheels, cleans debris from a plurality of said gaps between deck boards simultaneously.

14. A machine for cleaning gaps between deck boards comprising: an elongated handle; an elongated member attached perpendicularly at an intermediate point, either directly or with a handle adapter, to one end of said handle; a plurality of blades adjustable along and fastened to said member; two glides or wheels fastened perpendicularly to the bottom of said member and at predetermined points along said member; wherein said blades are independently adjusted and fastened along said member; said glides or wheels are vertically adjustable resting on top of said boards wherein the depth of said blades into said gaps is adjusted so that the operation of said tool will be unimpeded by the deck boards, gaps or deck structure when cleaning debris out of deck board gaps or gaps in architectural structures.

15. The machine of claim 14 wherein the length of said blades and slidability of said blades along said member, in combination with the vertical height adjustability of said glides or wheels, removes debris from a plurality of gaps between deck boards or gaps within architectural structures.

* * * * *